US005572912A

United States Patent [19]

Gasparre

[11] Patent Number: 5,572,912

[45] **Date of Patent: *Nov. 12, 1996**

[54] ANTI-CRIMP WRENCH FOR A GARDEN HOSE WITH A KNURLED COUPLING

[75] Inventor: Pasquale Gasparre, East Patchogue, N.Y.

[73] Assignee: Creative Designs in Woodworking and Metal, East Patchogue, N.Y.

[ * ] Notice: The portion of the term of this patent subsequent to Jun. 1, 2013, has been disclaimed.

[21] Appl. No.: 435,209

[22] Filed: May 5, 1995

[51] Int. Cl.[6] ..... B25B 13/06

[52] U.S. Cl. ..... 81/121.1; 81/124.3

[58] Field of Search ..... 81/121.1, 124.3, 81/116, 176.3, 3.44, 3.43, 3.4, 64

[56] References Cited

U.S. PATENT DOCUMENTS

| | | | |
|---|---|---|---|
| 1,461,983 | 7/1923 | Parker | 81/3.44 |
| 1,778,576 | 10/1930 | Walker . | |
| 2,733,937 | 2/1956 | Mowrer, Jr. . | |
| 3,964,115 | 6/1976 | Platek | 81/64 |
| 4,058,031 | 11/1977 | Magarian | 81/64 |
| 5,014,940 | 5/1991 | Sherman . | |
| 5,345,624 | 9/1994 | Brown, III | 81/3.43 |
| 5,367,925 | 11/1994 | Gasparre | 81/121.1 |

FOREIGN PATENT DOCUMENTS

| | | | |
|---|---|---|---|
| 2605918 | 5/1988 | France | 81/121.1 |
| 2554315 | 6/1976 | Germany | 81/121.1 |
| 84/04721 | 12/1984 | WIPO | 81/121.1 |

*Primary Examiner*—D. S. Meislin
*Assistant Examiner*—Joni B. Danganan
*Attorney, Agent, or Firm*—Alfred M. Walker

[57] ABSTRACT

An anti-crimp wrench is provided for a flexible garden hose wherein the anti-crimp wrench has a hinged longitudinally extending ferrule sleeve body portion further having a cap engagable with a knurled garden hose coupling attachable to the end of the garden hose. The cap extends at the distal end of the ferrule sleeve and is engagable over the coupling for tightening the coupling upon a hose faucet bib. The interior of the cap collar of the ferrule sleeve has a plurality of inner surfaces adapted to conform to the exterior surface of the knurled hose coupling, when the hose coupling is engagable over the faucet bib, threaded portion. The longitudinally extending ferrule sleeve has a plurality of longitudinally extending outer surfaces to facilitate the manual gripping of the ferrule sleeve by the whole hand of the user. The ferrule sleeve is slidably moveable about the garden hose along a predetermined longitudinal length, between an annular stop, which stops the movement of the ferrule sleeve, and the hose coupling.

19 Claims, 3 Drawing Sheets

Fig. 3
(Prior Art)
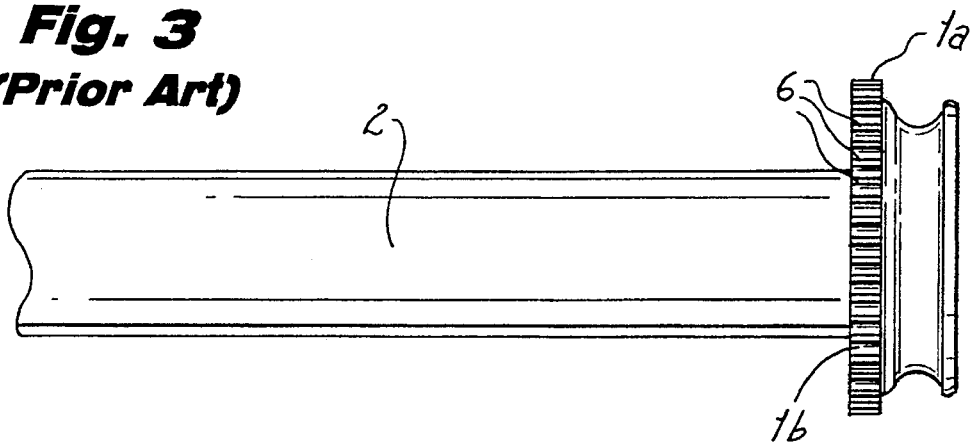
Fig. 4
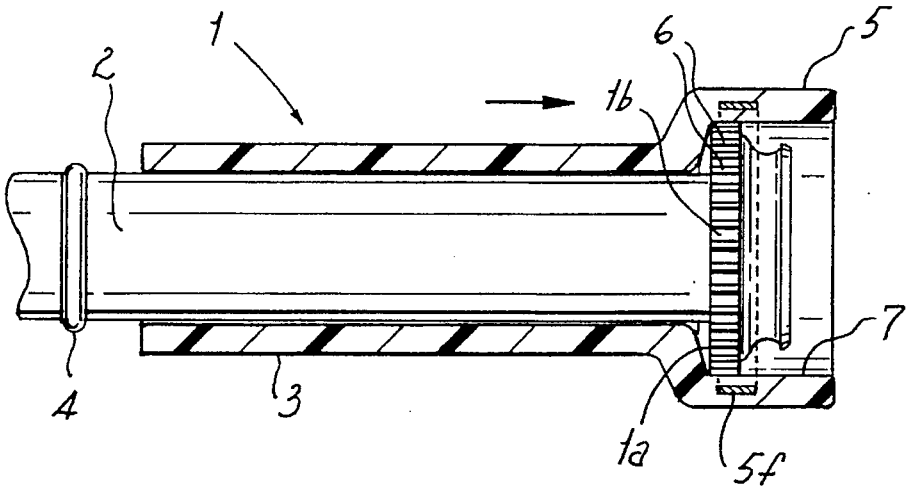
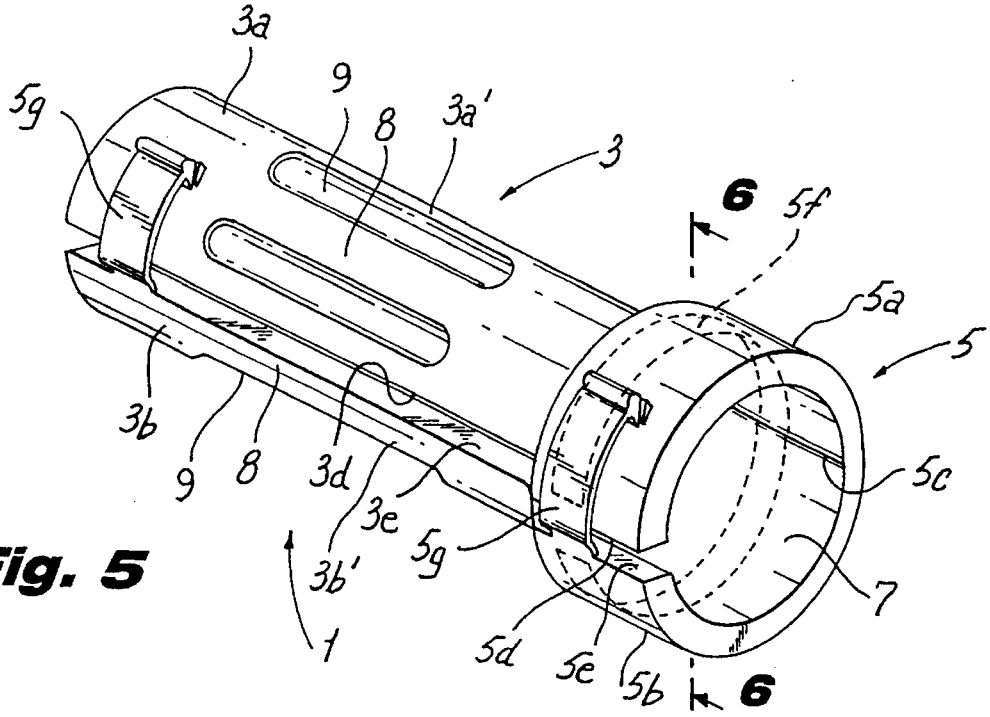
Fig. 5

ANTI-CRIMP WRENCH FOR A GARDEN HOSE WITH A KNURLED COUPLING

FIELD OF THE INVENTION

The present invention relates to a wrench and anti-crimp device for better hand gripping for locking and unlocking of a garden hose with a coupling from a garden hose bib faucet. The coupling may be knurled or polygonal.

BACKGROUND OF THE INVENTION

Lawn gardeners must repeatedly install and remove hoses which provide water to sprinklers, nozzles, and other water supply devices, such as lawn games. Often the connection between the water faucet bib is never completely tight, so that there occurs frequently leaks and the difficulties in irrigating with water.

Known wrench couplings cannot be used because the hose itself interferes with their use. The prior art of wrench couplings in general include U.S. Pat. No. 1,778,576 of Walker which describes a polygonal clamping element for work bench vises and U.S. Pat. No. 2,733,937 of Mowrer, which describes a polygonal wrench with a laterally extending handle which extends perpendicular to the axis of the polygonal socket.

French patent 2605-918A of Iwandza describes a hexagonal socket for a spanner wrench and German patent no. 2,554,315 of Gendrot describes a winged spanner wrench. None of these prior art devices can be used with hose couplings.

Moreover, it is known that water hose fittings are very difficult to manipulate manually with the fingers only, often requiring both manual dexterity and brute strength, in odd work places in tight spots close to the ground which the gardener may encounter. This is especially true for arthritic persons and senior citizens who prefer to actively engage in gardening.

A knurled coupling is a cylindrical coupling having an inside surface engagable with a faucet bib, and a round textured serrated outer edge, wherein the textured serrations provide a gripping surface. A polygonal coupling is a coupling having a polygonal outside surface with female threaded inside surface engagable with male threads of a faucet bib.

Efforts to ease the installation of garden hose couplings are described in U.S. Pat. No. 4,058,031 of Magarian, which discloses a flexible wrench collar with laterally extending protrusions located equal distantly about the wrench collar. However, considerable manual force is needed, since only the users fingers engage the collar.

What is needed, and what is not shown in the prior art, is a wrench adapter for a garden hose which enables a whole hand to be used to tighten or untighten the garden hose faucet coupling. Such a device is described in U.S. Pat. No. 5,367,925, dated Nov. 29, 1994, of the Applicant herein. However, Gasparre '925 is designed for polygonal shaped hose couplings with a hose extension provided therewith, not for circular, knurled hose couplings.

OBJECTS OF THE INVENTION

It is therefore an object of the present invention to provide an improved wrench for garden hoses with knurled couplings.

A further object of the present invention to provide an improved wrench for garden hoses with polygonal couplings.

A further object is to facilitate the easier engagement and disengagement of garden hoses.

A further object is to provide a wrench making it easier to tighten a hose coupling with the whole hand of the user.

It is yet another object to provide a wrench for a garden hose with a knurled coupling, which can be effectively used with a minimum of manual effort.

It is a further object to provide a garden hose wrench which prevents the hose from bending excessively in a crimp and which prevents leaks at the connection of the female connector of the garden hose coupling.

It is a further object of the present invention to provide a garden hose wrench which can be easily adapted and removed from a knurled coupling for a garden hose.

It is a further object to provide a garden hose wrench for garden hoses with knurled couplings which improves over the prior art.

SUMMARY OF THE INVENTION

In keeping with these objects and others which will become apparent, there is provided a novel garden hose anti-crimp wrench for a knurled coupling of a garden hose, as shown in the following drawings.

The wrench includes a foldable body sleeve wrench portion having a tightenable coupling portion for tightening upon knurled garden hose coupling. The foldable body sleeve wrench portion is slidably receivable about a portion of a hose adjacent to the knurled garden hose coupling. When tightened by a snap tightener, the tightenable coupling portion slidably engages and rotatably turns the knurled hose coupling to selectively tighten and loosen the knurled coupling from a hose faucet.

The gripping portion of the hose wrench is especially appropriate for persons disabled with arthritis, or for senior citizens who enjoy gardening.

The hose wrench can be installed as a solid walled hollow wrench upon a hose during manufacturing, or can be hinged and openable so as to be closable when applied over an existing hose and coupling.

DESCRIPTION OF THE DRAWINGS

The present invention can best be understood in conjunction with the accompanying drawings, in which:

FIG. 3 is a side elevational view of a prior art garden hose with a knurled coupling;

FIG. 4 is a cross sectional view of the garden hose wrench of the present invention, shown in place upon a garden hose with a knurled coupling;

FIG. 5 is a perspective view of the wrench as shown in FIG. 4;

DESCRIPTION OF THE PREFERRED EMBODIMENTS

Figure 6:
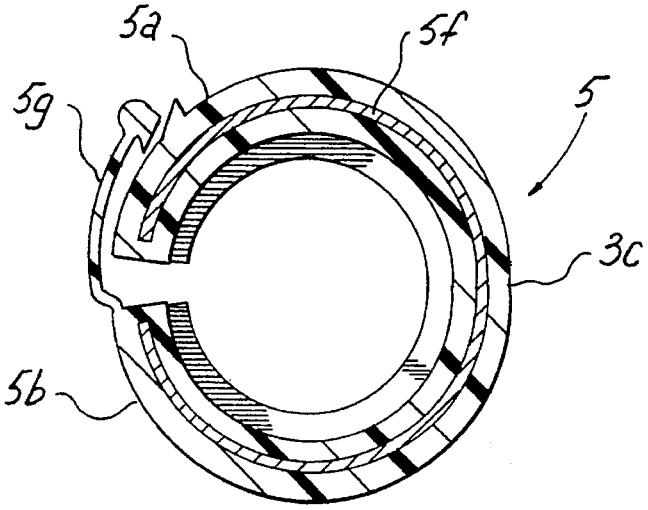
FIG. 6 is an end view in cross section of the present invention as in FIG. 4.

Referring to the drawing FIGS. 4–6, the garden hose wrench of the present invention is generally shown as 1. Wrench 1 mounts upon a knurled coupling 1*a* of hose 2.

Wrench 1 includes a hinged, foldable body sleeve wrench portion 3 having a tightenable cap collar portion 5 for tightening upon knurled garden hose coupling 1*a*.

Wrench 1 is made of a semi-rigid elastomeric material, such as plastic or rubber, so that cap coupling portion 5 can be squeezed and tightened to form a tight fit around the exterior of knurled coupling 1*a* of hose 2. Cap 5 of hinged, foldable body sleeve portion 3 is slidably receivable about a portion of a hose 2 adjacent to knurled garden hose coupling 1*a*. When tightened by a snap tightener 5*g*, tightenable cap coupling portion 5 slidably engages, and rotatably turns, knurled hose coupling 1*a*, to selectively tighten and loosen knurled coupling 1*a* from a conventional hose faucet.

In order to insert wrench 1 over hose 2, hinged body sleeve portion 3 includes two half sleeve portions 3*a*, 3*b* joined together at hinged rear 3*c*. Hinged rear 3*c* may be a living hinge, inwardly biased to hold half sleeve portions 3*a*, 3*b* together in a generally cylindrical sleeve shape. To open sleeve 3, force is applied outward to separate hinged sleeve portions 3*a*, 3*b*, so that sleeve 3 can be placed over hose 2. Inwardly biased rear living hinge 3*c* then closes sleeve 3 over hose 2. A similar inwardly biased rear living hinge 5*c* closes cap collar 5 over knurled cap coupling 1*a* of hose 2.

For use, half sleeve portions 3*a*, 3*b* and half collar portions 5*a*, 5*b* are closed together, and joined at edges 3*d*, 3*e* and 5*d*, 5*e* respectively so that hinged body sleeve portion 3 fits around hose 2 and cap collar 5 fits snugly over coupling 1*a*. Hinged ferrule sleeve 3 is then slidable about hose 2 to couple and uncouple knurled coupling 1*a*.

Other round couplings may have other textured surfaces and wrench 1 may be also adapted and made to fit these other shapes. Coupling 1*a* of garden hose 2 has on its exterior generally an equidistant plurality of textured ridge serrations 6 on exterior surface 1*b* of coupling 1*a*. Coupling 1*a* has a threaded interior, to engage the exterior of a conventional garden hose faucet bib.

Exterior ridge serrations 6 of coupling 1*a* engage with interior collar cap portion 7 of hinged ferrule sleeve 3, so that when collar cap 5 and sleeve 3 is tightened by snap fastener 5*g*, manual pressure with the whole hand may be brought upon coupling 1*a* by manual movement of ferrule sleeve 3, clockwise or counterclockwise to engage or disengage knurled serrated ridge surfaces 6, etc. of the coupling 1*a*.

Interior surfaces 7 of cap collar 5 of ferrule sleeve 3 tightly grip ridge serrations 6 of knurled cap 1*a*, so that when ferrule sleeve 3 is fitted externally over knurled hose coupling 1*a*, cap collar 5 engages and presses upon exterior ridged serrations 6 of hose coupling 1*a* of hose 2 tightly, so that hose coupling 1*a* may be loosened or tightened as needed.

Cap collar 5 is generally made of an elastomeric material which does not break under stress, but which can be squeezed tightly by snap fastener 5*a*. Ferrule sleeve 3 has end collar 5 at one end, which collar 5 is tapered or reduced at a proximal end to ferrule sleeve 3 at the top of sleeve 3. Cap collar 5 may have an annular strip 5*f* therein, such as metal, to reinforce cap collar 5.

Cap collar 5 may have at an interior surface optional parallel ridges engagable with ridged serrations 6 of coupling 1*a*.

Exterior half sleeve portions 3*a*, 3*b* of the ferrule sleeve 3 may have longitudinally extending ridges 8, on exterior sides 3*a*', 3*b*' respectively, or depressions 9, to facilitate manual gripping of wrench 1 about coupling 1*a* of the hose 2.

In use, ferrule sleeve 3 is slidably mounted upon the hose coupling 1*a*. Cap collar 5 of ferrule sleeve 3 is moved against an outer end of hose coupling 1*a* so that inner surface 7 of cap collar 5 engage upon coupling 1*a*. Ferrule sleeve 3 is open at both ends and wrench 1 is slidable longitudinally about the longitudinal axis of flexible garden hose 2, between coupling 1*a* to be tightened or loosened, and optional annular ring stop 4, to prevent the movement of ferrule sleeve 3 below a predetermined longitudinal length of hose 2.

Because the ferrule sleeve 3 is movable about hose 2, it can be easily detached or attached to coupling 1*a* for tightening or loosening of coupling 1*a* of hose 2 about a faucet bib attached to a house or other water source.

As noted, ferrule sleeve 3 is open at both ends. At the upper end, ferrule sleeve 3 extends to encompass cap collar portion 5 for engagement upon an octagon shaped coupling 1*a* of a garden hose.

Figure 7:
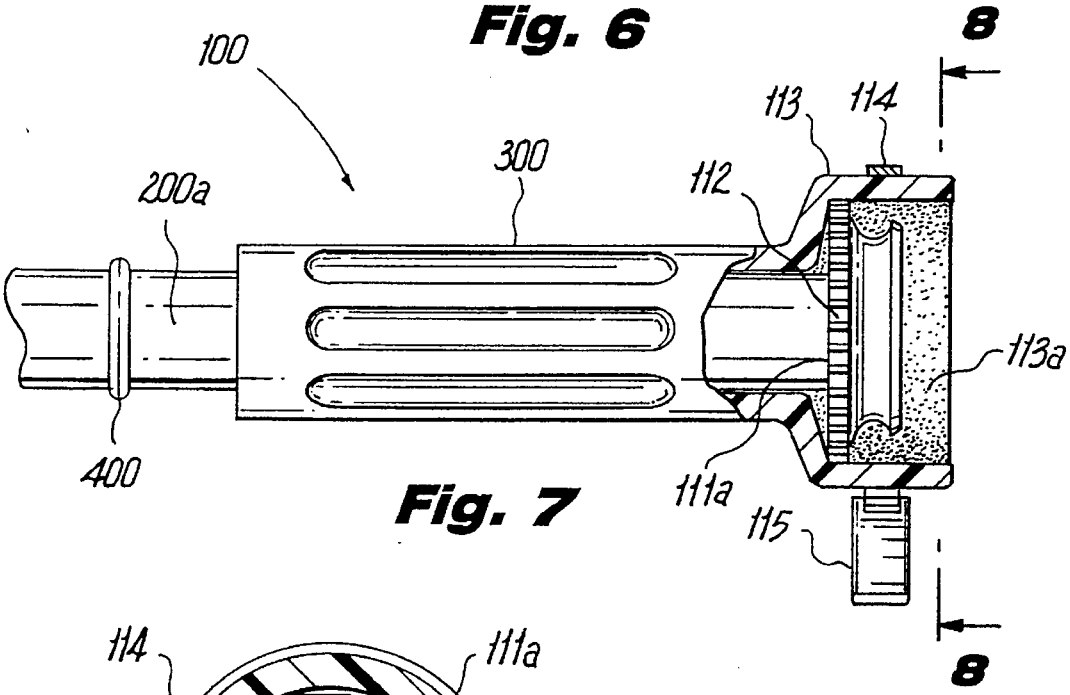
FIG. 7 is a side elevational view of an alternate embodiment of the present invention in use.
Figure 8:
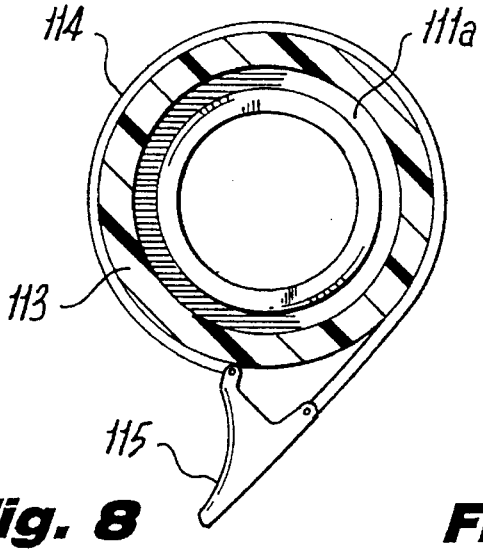
FIG. 8 is an end elevational view in cross section of the knurled garden hose fitting as in FIG. 7; and, FIG. 9 is a close up view in partial section of the snap portion of the present invention for a knurled garden hose fitting as in FIG. 7.
Figure 9:
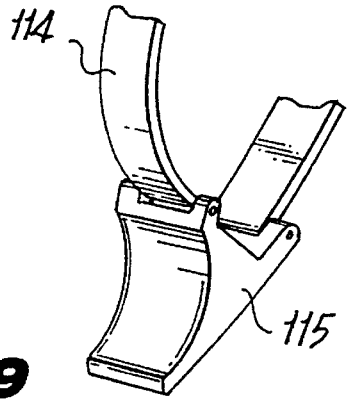

As shown in FIGS. 7–9 there is provided an alternate embodiment of wrench 100, with an optional hose extension portion 200*a* for engagement about serrated ribbed knurled hose coupling 111*a*, having a circular circumference of parallel serrated ridges 112.

As shown in the drawings 7–9, in the alternate embodiment, wrench 100 includes a closed ferrule sleeve 300 slidably mounted over hose extension 200*a*, which wrench 100 is stopped from longitudinal movement by an annular stop 400. Cap collar 113, is insertable over a conventional knurled hose coupling 111*a* of garden hose extension 200*a*, which has a threaded male end opposite to coupling 111*a* for insertion within a conventional threaded ferrule coupling of a hose 200.

Optionally, cap collar 113 on its inside may include corresponding textured surface 113*a* for engagement upon ridged serrated surface 112 of coupling 111*a*. Further annular tightening ring 114 circumscribes over cap collar 113 and further outer ring 114 is tightened by means of a snap lock lever 115, or offset cam, to tighten the cap collar 113 about ridged coupling 111*a*. When wrench 100 is to be released snap lock 115 is released so that the cap collar 113 may be removed from coupling 111*a*.

In a further embodiment, cap collar 5 or cap collar 113 may be provided with a metal annular strip within the plastic cap collar 5 or 113, for better gripping upon the serrations of respective couplings 1*a* or 111*a*.

In both embodiments, shown in FIGS. 4–6 and 7–9, wrench 1, and wrench 100, which are engagable upon respective knurled hose couplings 1*a* and 111*a*, and respective cap collars 5 or 113, engage over knurled surfaces tightly of the hose couplings 1*a* or 111*a* for frictional engagement. When mounted, exterior ferrule sleeve 3 of the wrench 1 or ferrule sleeve 300 of wrench 100 can be easily held and turned with the whole hand, not just by the fingers of the prior art devices.

The manual engagement forces imparted upon ferrule sleeve 3 or sleeve 300 serve to cause respective cap collars 5 or 113 to tighten against respective knurled hose coupling 1*a* or 111*a* so that couplings 1*a* or 111*a* may be tightened or loosened about respective faucet bibs.

The extended longitudinal length of ferrule sleeves 3 or 300 of wrench 1 or 100, also act as anti-crimp devices by maintaining respective flexible hoses 2 or 200 in generally straight longitudinal positions from the point of the coupling until the end of longitudinal length of ferrule sleeves 3 or 300, which is the most usually crimped, or bent portion of a garden hose 2 or 200, namely at couplings 1*a* or 111*a* or within the vicinity thereof. Thus, ferrule sleeves 3 or 300 act as wrenches to loosen or tighten respective couplings 1*a* or 111*a* from the faucet, but also, as anti-crimp devices to maintain hoses 2 or 200 in a generally straight longitudinal direction without any impeding bends or crimps in the flexible hose 2.

Figure 1:
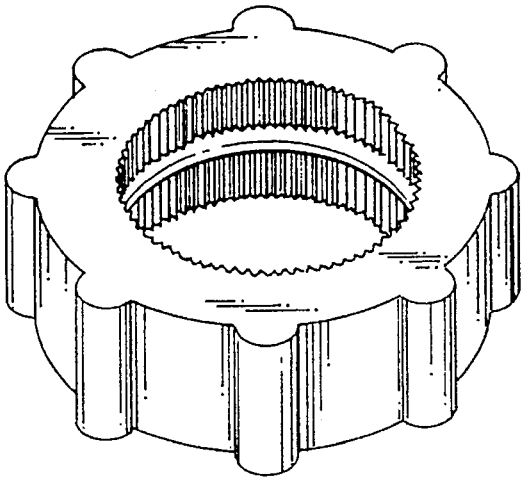
Fig. 1 (Prior Art)
FIG. 1 is a perspective view of a prior art hose wrench.
Figure 1A:
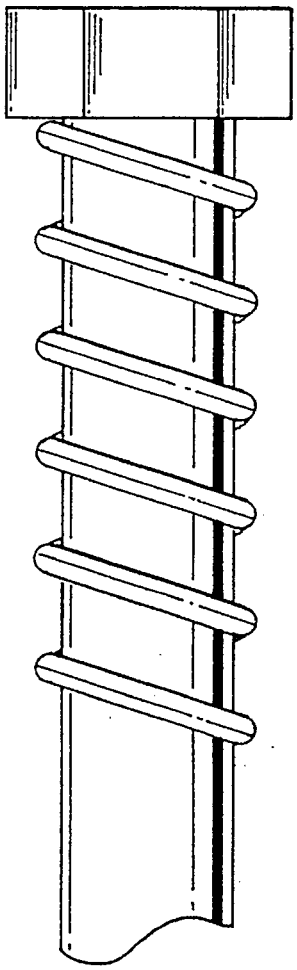
Fig. 1A (Prior Art)
FIG. 1A is a side elevational view of a prior art anti-crimp device on a hose.
Figure 2:
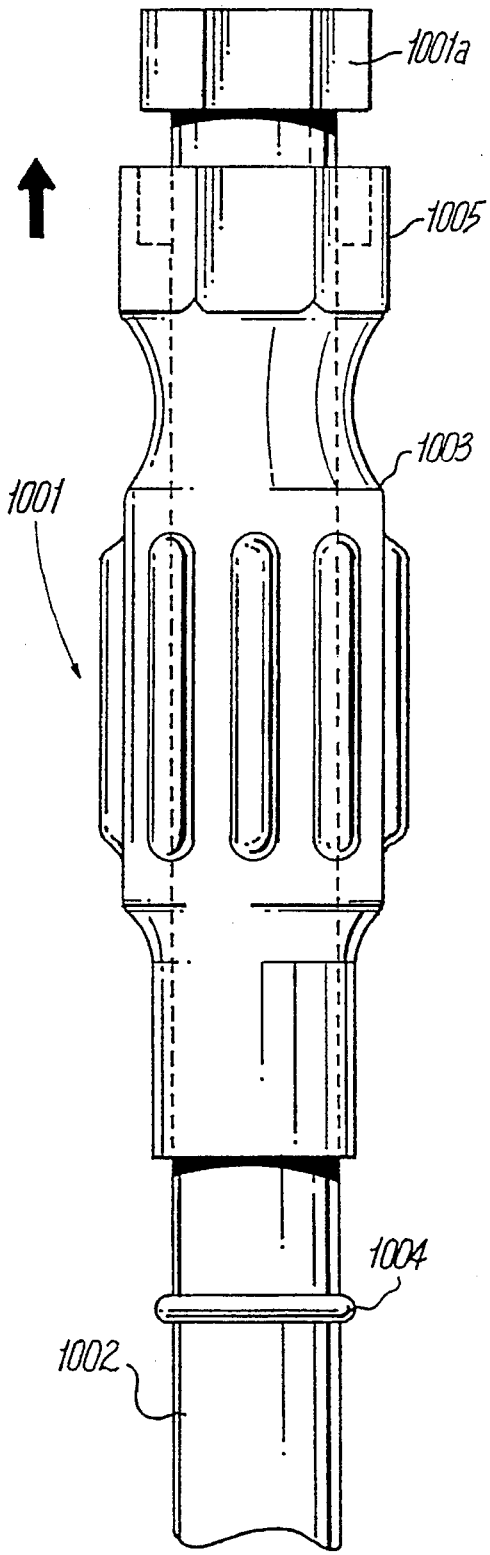
FIG. 2 is a side elevational view of an alternate embodiment for a hose wrench and hose combination.

In a further embodiment, as shown in FIG. 2, wrench 1001 includes a rigid, one piece body sleeve wrench portion 1003 which is inserted over a coupling 1001*a* of a conventional hose 1002 during manufacturing of hose 1002. Cap coupling 1005 has a polygonal interior shape, such as an octagon, for tightening upon a corresponding exterior polygonal hose coupling 1001*a*, which coupling 1001*a* also includes a female threaded portion engagable with a faucet bib.

Cap 1005 is slidably receivable over hose 1002, to form a tight fit over hose coupling 1001*a*, to selectively tighten and loosen coupling 1001*a* from the threaded male faucet bib.

An optional ring 1004, such as an O-ring, is provided upon hose 1002 to limit the longitudinal movement of sleeve wrench 1001 upon hose 1002. Wrench 1001 includes sleeve portion 1003 open at both ends, and attached to cap 1005 at a faucet engaging end thereof. Therefore, polygonal hose wrench 1001, or a similar knurled version, as shown in FIGS. 4–6 and 7–9 herein, can be applied over a full length hose as a manufacturer desires, as a premium hose.

Other modifications may be made to the present invention, without departing from the spirit or scope of the present invention, as noted in the appended claims.

I claim:

1. A hose and wrench combination for a garden hose, comprising:

a. a hose having a threaded male end and a threaded female end, said threaded female end having a coupling portion for tightening and loosening said threaded female end about a remote complimentary threaded male end; and b. a body sleeve wrench portion slidably receivable about said hose between said threaded male end and said threaded female end; said body sleeve wrench portion having a complimentary coupling portion at one end sized to slidably engage and rotatably turn a coupling portion of said threaded female end of said hose, to selectively tighten and loosen said threaded female end of said hose from the remote complimentary threaded male end.

2. The hose and wrench combination of claim 1 wherein said coupling portion has an inside surface having a plurality of serrated ridge portions engagable with a knurled outside surface of said coupling portion of said hose.

3. The hose and wrench combination of claim 1 wherein said hose comprises a partial hose extension having a threaded male end engagable with a female coupling of a hose and a female cap collar end engagable with a remote male threaded faucet bib.

4. The hose and wrench combination of claim 1 further comprising an annular stop ring surrounding said hose, said annular stop ring being located around said hose at a predetermined distance from said threaded male end of said hose, to permit said body sleeve wrench portion to move slidably about said hose between said annular stop ring and said polygonal coupling portion of said female end of said hose.

5. The hose and wrench combination as in claim 1, wherein said body sleeve wrench portion includes a plurality of longitudinally extending ridge surfaces for facilitating the manually gripping of said body sleeve wrench portion with a palm gripping portion of a hand of a user.

6. The hose and wrench combination as in claim 5, wherein said longitudinally extending ridge surfaces of said body sleeve wrench portion include a plurality of longitudinally extending depressions.

7. The hose and wrench combination as in claim 1, wherein said longitudinally extending ridge surfaces of said body sleeve wrench portion include a plurality of longitudinally extending protrusions.

8. An anti-crimp wrench for a garden house having a coupling, said anti-crimp wrench comprising a ferrule sleeve body portion having a cap collar portion at one end and a distal end at another end, said cap collar portion adapted to be movable about a work piece for tightening thereof, said cap collar portion having an inner surface adapted to conform to the coupling of the hose when said cap collar portion is moved thereabout, said ferrule sleeve body portion having an extended longitudinal opening of a predetermined length, said cap collar portion having an elastomeric surface adaptable to a corresponding knurled surface of the coupling, said elastomeric surface being adjacent to said distal end of the ferrule sleeve body portion, said elastomeric surface having a diameter of slightly larger than a diameter of an exterior surface of the coupling to permit movement of said cap collar portion of said ferrule sleeve body portion upon the coupling, said ferrule sleeve body portion having a longitudinally extended outer surface for grasping said ferrule sleeve body portion of said anti-crimp wrench.

9. The anti-crimp wrench of claim 8 wherein said distal end of said cap collar portion of said wrench extends upwardly from said ferrule sleeve body portion for guiding said anti-crimp wrench in engagement with a coupling of the garden hose, and wherein said cap collar portion includes an annular reinforcement strip therein.

10. The anti-crimp wrench as in claim 8 wherein said ferrule sleeve body portion is hinged and openable.

11. The anti-crimp wrench as in claim 8 wherein said inner surfaces are ridged with ridges of parallel ridges, said cap collar portion being tightened further by an annular ring, said ring lockable by a snap lock for a frictional engagement of the interior surfaces of said cap collar portion upon a ridged cylindrical hose coupling.

12. The snap lock as in claim 11 wherein said spring lock is an offset cam.

13. A hose and wrench combination comprising a hose and the anti-crimp wrench of claim 8, the hose further having a annular stop ring at a predetermined distance about a annular portion of the hose to permit said ferrule sleeve body portion to move slidably within a set predetermined distance between said annular stop and the hose coupling.

14. The anti-crimp wrench as in claim 8 in which the inner surfaces of said cap collar portion have a diameter slightly larger than a diameter of the surfaces of the hose coupling.

15. The anti-crimp wrench for a garden hose as in claim 8, further comprising said ferrule sleeve body portion having open ends, and said cap collar portion having an inner surface adaptable to conform to the knurled exterior surfaces of the coupling of the garden hose.

16. The anti-crimp wrench as in claim 8, wherein said ferrule sleeve body portion is of a predetermined length for the garden hose in a longitudinally extending orientation therein.

17. The anti-crimp wrench as in claim 8, wherein said ferrule sleeve body portion comprises a plurality of exterior surfaces for manually gripping said sleeve with the whole hand of a user.

18. The anti-crimp wrench as in claim 17, wherein said exterior surfaces of said ferrule sleeve body portion include a plurality of longitudinally extending protrusions.

19. The anti-crimp wrench as in claim 17, wherein said exterior surfaces of said ferrule sleeve body portion comprise a plurality of longitudinally extending depressions.

* * * * *